US005320340A

United States Patent [19]

Bay

[11] Patent Number: 5,320,340

[45] Date of Patent: Jun. 14, 1994

[54] METHOD AND APPARATUS FOR THE POSITIONALLY CORRECT SUPPLY OF DIFFERENTLY SIZED SHEETS TO A SHEET FOLDING MACHINE

[76] Inventor: Otto Bay, Luzernstrasse 45, 4553 Subingen, Switzerland

[21] Appl. No.: 117,215

[22] Filed: Sep. 3, 1993

[30] Foreign Application Priority Data

Sep. 8, 1992 [CH] Switzerland ..... 02810/92

[51] Int. Cl.[5] ..... B65H 5/06; B65H 9/00

[52] U.S. Cl. ..... 271/225; 271/176; 271/184; 271/270

[58] Field of Search ..... 271/225, 227, 184, 185, 271/176, 270, 202

[56] References Cited

U.S. PATENT DOCUMENTS 5,045,039 9/1991 Bay .
5,154,405 10/1992 Graveson ..... 271/225 X
5,188,355 2/1993 Lowell ..... 271/225

FOREIGN PATENT DOCUMENTS

650221A5 7/1985 Switzerland .

*Primary Examiner*—Richard A. Schacher
*Attorney, Agent, or Firm*—W. G. Fasse; W. F. Fasse

[57] ABSTRACT

In order to select certain sheet sizes or formats for a rotation by 90° in the plane of the sheet, sensors are provided which sense the presence of a sheet on a supply and turning table. The sensors provide a respective signal for the control of a sheet turning mechanism. After turning the sheets are fed in the proper positional orientation to further processing, for example, in a folding apparatus. The turning mechanism also performs a sheet lifting and lowering operation. The sheet transport out of the turning mechanism is performed at a speed higher than the speed of the sheets travelling into or onto the turning mechanism to provide the time necessary for the sheet turning operation which takes place in three steps: sheet lifting, sheet turning, and sheet lowering in response to a control signal from the sensors which determine what sheet format needs to be reoriented.

21 Claims, 5 Drawing Sheets

METHOD AND APPARATUS FOR THE POSITIONALLY CORRECT SUPPLY OF DIFFERENTLY SIZED SHEETS TO A SHEET FOLDING MACHINE

FIELD OF THE INVENTION

The invention relates to a method for feeding sheets of different sizes to a folding machine in such a way that the sheets arrive in the folding machine in a positionally corrected orientation for the proper folding. The invention also relates to an apparatus for performing such method.

BACKGROUND INFORMATION

Electrostatic printers are known for printing large format drawings, for example. The printing paper is pulled off from supply rollers. Depending on the size of the drawings, two or more paper supply rollers having paper webs of a different width may be positioned for cooperation with the printer. The printing of the drawings takes place either relative to the sheet length or crosswise thereto.

Once the printing is completed, these large format drawings are folded by machines capable of handling such large formats. U.S. Pat. No. 5,045,039 (Bay), issued on Sep. 3, 1991, discloses such a folding machine. Such a machine folds large sheets of different sizes with different folding patterns and the sheets are so folded that the parts list or legend head of the sheet appears in the proper position on the folded sheet. In other words, for proper recognition of the drawing, the legend head must appear on the top sheet section of the folded sheet. For this purpose it is necessary that the sheets are fed to the folding machine in the proper positional orientation.

Further, it is known to program such folding machines in such a way that the number of folds to be formed may vary, depending on a length of the sheet. However, independently of the number of folds to be made it is always necessary that the legend head or parts list must appear on the top sheet section when the folding operation is completed and this requirement must be met independently of the lengthwise or crosswise orientation of the sheet prior to entering into the folding machine. This requirement that the legend head or parts list must appear in a predetermined position on the top sheet section of the folded sheet requires that, for example, in drawings that are printed on a sheet taken off from a wide roller in a longitudinal format, can be fed directly into the following folding apparatus. However, when drawings are printed onto sheets in a cross-format, that is with a half size, and the sheet has the same width from a supply roll having the same width, it is necessary that the sheet on its way to the folding machine is turned by 90°, for example, on a supply and sheet orienting table. Such orienting takes place in the plane of the drawing in order that the folding operation can be correctly performed. The same considerations apply where one or more paper rolls having a smaller width are used as the paper supply.

Swiss Patent CH 650,221 (Bay), issued on Jul. 15, 1985, discloses an apparatus for transporting sheets having a rectangular format, however, of different sizes. In such an apparatus it is necessary that the individual sheets in accordance with their format, travel so that the correct sheet edge forms the leading edge when such sheets enter a folding machine and/or an edge branching automat. The sheet transport takes place as an automatic feed advance by linearly effective transport elements such as rollers and the like. In order to assure that the proper edge forms the leading edge, sensors are provided for recognizing the sheet format. The sensors are arranged above the supply table and cooperate with an adjustable holding member which permits rotating of sheet of a certain format about a vertical eccentrically arranged axis, whereby the holding member forms the axis and transport elements then turn the respective sheet about the vertical axis on the table. The known apparatus works so slow for rotating large sheets and needs a large table for transporting the sheet in different directions.

OBJECTS OF THE INVENTION

In view of the foregoing it is the aim of the invention to achieve the following objects singly or in combination:

- to provide a sheet turning method and apparatus capable of rotating in one plane sheets of various large scale sizes which may arrive in random orientation as longitudinal formats and/or cross-formats;
- to make sure that the rotation in the plane of the sheet takes place depending on the size of the sheet so that the sheets may be fed to a further processing apparatus such as a folding machine with the proper positional orientation;
- the sheet turning apparatus shall require but a small space between the printer and the folder;
- the proper sheet orientation shall be possible on a continuous sheet supply arriving randomly; and
- the rotation of a sheet in its sheet plane must not cause any interference with further sheets arriving in the sheet rotating position.

SUMMARY OF THE INVENTION

According to the invention the above objects have been achieved by a method for feeding of sheets having differing, rectangular formats and coming from a printer, for example an electrostatic printer, a copier, a plotter, or the like, with a first feed-in speed to a feed-in and sheet turning table and then on to a folding machine, in which the turned sheets must arrive with the proper positional orientation to assure a correct sheet folding. Sensors are positioned for ascertaining the sheet format and size to provide respective control signals for performing the following steps: selecting a sheet format for turning by at least 90° relative to the plane of the turning table, lifting a sheet having a selected format above the plane of the turning table, rotating the lifted sheet by 90° in its lifted state, lowering the rotated sheet, and feeding the lowered sheet with a second sheet length dependent feed-out speed in a direction toward the folding machine or the like. The sheet length dependent second feed-out speed is so controlled by the control signals that the second feed-out speed is normally higher than the first feed-in speed for relatively short sheets. For relatively long sheets the second speed is about the same as the first speed. The terms "long" and "short" in this context have reference to the length of the sheet turning table in the sheet travelling direction.

The apparatus according to the invention for performing the present method is characterized in that a feed-in and sheet turning table is arranged between a first sheet handling device, such as a printer or the like, and a folding machine. The feed-in and turning table comprises a lifting and turning mechanism that cooperates with the feed-in and turning table. The lifting and turning mechanism holds a selected sheet, lifts it, turns it, and lowers the turned sheet again which is then transported by the feed-in and turning table with a sheet length dependent feed-out speed in a feed-out direction to avoid sheet jamming. The feed-out speed will normally be higher than an initial feed-in speed of the sheet into the apparatus, specifically onto the turning table, relatively short, namely shorter than the length of the table in the sheet travelling direction. If the sheets are relatively long, namely longer than the table, the two speeds will be substantially equal to each other.

The present method and apparatus make sure that drawing sheets arriving from a printer or the like and which have random longitudinal or cross-formats are supplied to a following folding machine automatically in a positionally correct orientation, whereby a correct folding operation is assured so that the cover section of a drawing sheet with its parts list and/or legend head appears on top of the folded sheet. This proper orientation is achieved automatically without any manual involvement by the operator. Due to the rotational motion of preselected sheet formats or sizes, it is possible to obtain a very compact construction of the feed-in and turning table, thereby requiring but little space for the feed-in and turning table between the printer and the folding machine.

By feeding the turned sheets away from the feed-in and turning table with a higher speed compared to the speed at which the sheets arrive at the feed-in and turning table, it is possible to supply the table continuously with sheets without disturbing the lifting and rotational and lowering movements of the feed-in and turning table by the sheet supply when a predetermined sheet format must be turned. The randomly arriving sheets of different sizes and formats are recognized by sensors as the sheets arrive on the supply table and selected sheets cause the generation of the signals required for the lifting of a selected sheet, turning the lifted sheet by 90°, and lowering the turned sheet for the positionally correct supply of the reoriented sheet to the folding machine. The sensors can differentiate between sheets that can pass the table without reorientation and sheets that require reorientation because of the spacing between several sensors arranged in a row in the sheet travel direction, and at least one laterally positioned sensor provides signals, which in combination give information regarding the sheet size that requires reorientation by turning. These signals, with proper signal processing, are used to control the drives for lifting, turning, and lowering the table.

The term "positionally correct orientation" in this context means that the sheets are supplied to the folding machine in such a way that the parts list and/or the legend head appears on the top section or cover section of the folded sheet, preferably the parts list and/or legend head appear at the foot of the cover section of a folded sheet.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 2:
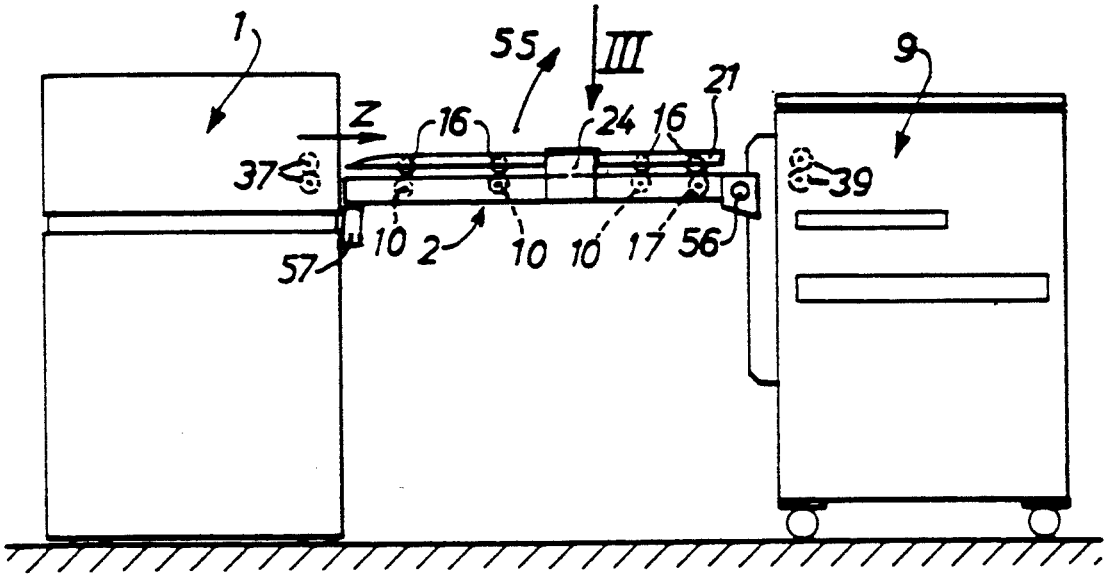
FIG. 2 is a simplified elevational side view of the apparatus according to the invention illustrating a printer, a folding machine, and the present sheet supply on a turntable positioned between a printer and a folding machine.

Referring first to FIG. 2, a sheet orienting supply or sheet turntable 2 according to the invention is positioned between a printer 1 or the like and a folding apparatus 9. The sheets travel in the direction of the arrow Z driven by first feed advance rollers 10 at a first lower feed-in speed onto a lifting and rotating mechanism 18 according to the invention to be described in more detail below. The lifting and rotating mechanism 18 for selected sheets cooperates with a counter holder secured to a yoke 24 mounted above the table 2. Further, the sheet orienting and supply table 2 is supported by a fixed stop 57 and hinged at 56 to the folding apparatus 9 so that the feed-in or supply table 2 may be tilted out of the way when it is not in use as indicated by the arrow 55. Second roller 17 moves all sheets from the table 2 to the folding machine 9 at a second speed higher than the first speed to provide time for the reorientation of selected sheets. Ball weights 16 arranged in longitudinal ball holders 21 cooperate with the rollers 10 and 17 to assure proper sheet advance.

Printers, especially electrostatic printers, such as so-called plotters, receive the paper supply primarily from large surface paper webs pulled off a respective supply roller. Depending on the type of printer or the like, it is conventional to provide such an apparatus with two or several paper supply rollers, each having a different paper width supplied as a continuous web. The drawing sheets, after having been printed and cut off from the supply roller, arrive at random on the feed-in or supply table 2. These sheets have standardized rectangular sizes and the size of the individual sheet is determined by the content of the drawings, for example, in the form of large surface area machine drawings or architectural drawings. Independently of their size, the sheets 3 have a legend head 11, 12 and/or they are provided with a parts list. The legend head and/or parts list must appear on the top sheet section after folding. Since the folding program of the folding machine is a given fact that cannot be easily changed, it is necessary that the individual drawings arrive in a positionally correct orientation in the folding machine. In order to achieve this, at least some of the sheet formats must be rotated by 90° on the supply or feed-in table prior to feeding the sheets into the folding machine.

Figure 1:
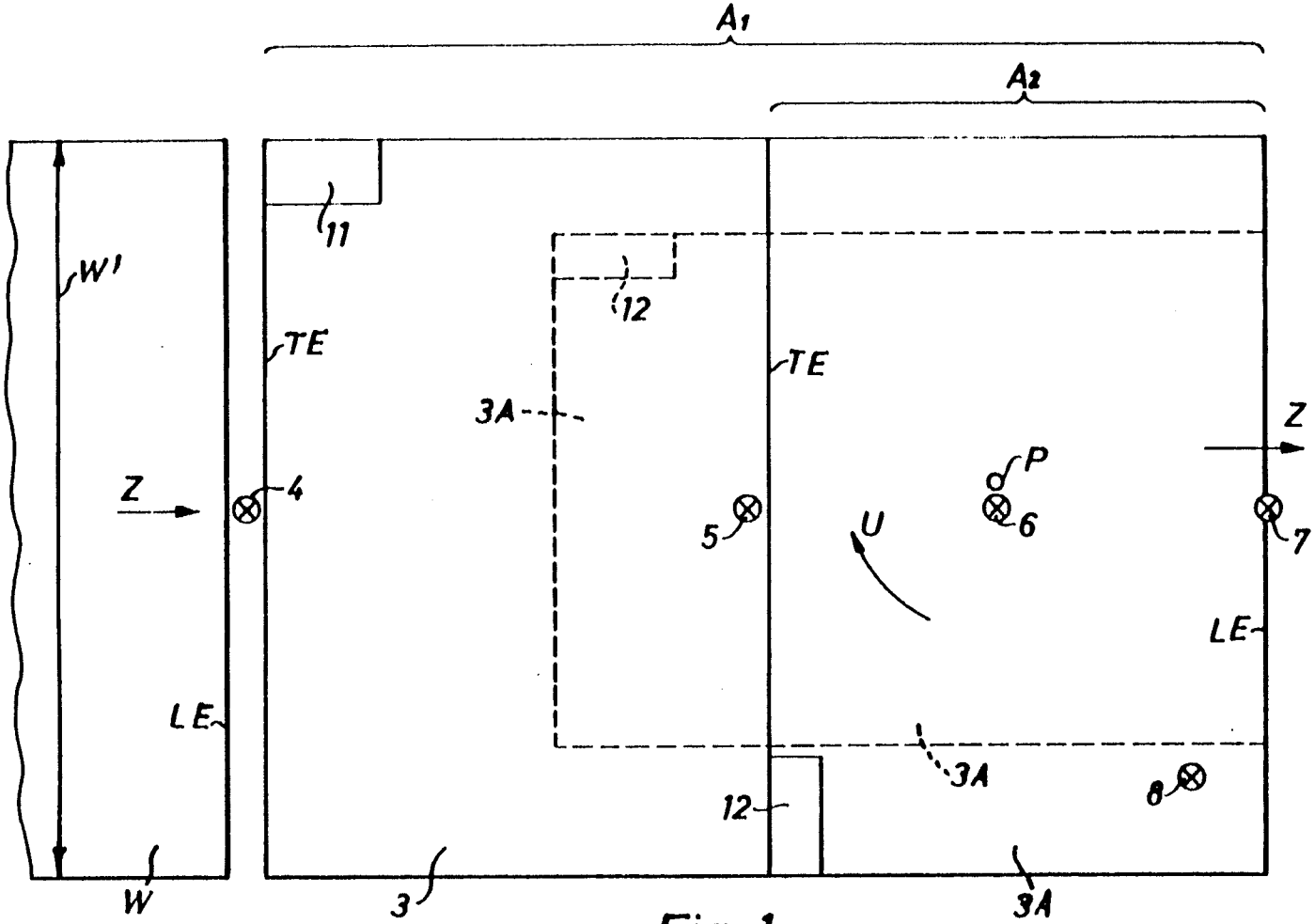
FIG. 1 is a schematic plan view illustrating different sheet formats travelling in direction Z, thereby activating or deactivating several sensors.

FIG. 1 illustrates an example of a sheet 3 coming from a printer. The sheet travels in direction Z. The sheet 3 has a so-called A1 standardized format of 594 mm×841 mm. The sheet 3 carries a legend head or parts list 11 in its upper left-hand corner. This orientation of the legend head 11 is acceptable to the folding machine. Therefore, the sheet 3 does not need to be turned. The material web W is shown on the left-hand side of FIG. 1. The web width W' extends crosswise to the travel direction Z. The printer may also print on the same width W' a sheet 3A in the standardized sheet size A2 which is shown in dashed lines and in full lines in FIG. 1. The standardized size A2 is 420 mm×594 mm. The sheet 3A has a parts list or legend head 12 that extends in the width direction crosswise to the direction Z in the full line position of the sheet 3A. This orientation of the legend head 12 is not suitable for proper folding. Incidentally, FIG. 1 is not to scale. However, the standardized sheet size A2 has half the surface area of the standardized sheet size A1.

Since the legend head 12 must be oriented as shown in the dashed line orientation in FIG. 1 so that the length of the legend head 12 extends in parallel to the direction Z, the sheet 3A must be brought from its full line position into the dashed line position by rotation as indicated by the arrow U. Similarly, sheets of other standardized formats may require reorientation, depending on the location of their legend heads. Thus, the printer can issue, for example, sheets of the width of standardized format A3 for example from a second narrower supply roller or standardized sheets A4 having a size 210 mm×297 mm from a still narrower supply roller. The format A3 would have a properly oriented legend head as printed. However, the format A4 would have to be turned. The formats A3 and A4 are not shown in FIG. 1 so as to not crowd the illustration. A conventional sheet cutter is part of the printer.

The sheets coming from the printer 1 onto the feed-in and turning table 2 are sensed by sensors 5, 6, 7, and 8 which ascertain the format of the incoming sheet and provide respective signals to a control circuit as will be described in more detail below with reference to FIG. 5. The sensors 5, 6, and 7 arranged in the middle part of the table spaced from each other lengthwise in the travel direction Z and a lateral sensor 8 cooperate in ascertaining the presence of a sheet that requires to be reoriented. In the example of FIG. 1 it is the incoming sheet 3A which does not cover the sensor 5 and the absence of a signal from the sensor 5 signifies the presence of a sheet 3A. The sensor 4 senses the leading edge of a sheet and thus provides a signal that a sheet is coming and the motors for the drive rollers 10 and 17 are switched on. The sheet 3 covers all sensors 5, 6, 7, and 8, thereby providing a signal combination signifying that a turning will not be necessary for the sheet 3. Thus, the sheet 3 travels directly to the folding machine 9. The format selector switch 15 comprises a fixed circuit or a keyboard on which an operator can determine which signal combination from the sensors 5 to 8 will cause a respective control to be described in more detail with reference to FIG. 5. In the case of the sheet 3 sensors 5, 6, 7, and 8 will provide a signal combination signifying that a turning of the sheet 3 is not necessary. Thus, the sheet 3 is transported directly into the folding machine 9.

On the other hand, when the sheet 3A having a format A2 is fed onto the table 2, the sensor 5 will no longer sense the sheet 3A when the latter has reached its end position on the table 2 because the trailing edge TE of the sheet 3A is outside the sensor 5. The resulting signal combination from the sensors 6, 7, and 8 now signifies through the selector circuit 15 that the sheet must be turned. Circuit 15 includes comparators for comparing preselected signal combinations with actually received signal combinations thereby providing a control signal for the turning operation. More specifically, as soon as the sensor 7 provides a signal of the presence of the leading edge LE of the sheet 3A while the sensor 5 simultaneously indicates that the trailing edge TE has passed the sensor 5, now the rotation of the sheet in its own plane by 90° in the clockwise direction is initiated as indicated by the arrow U. The rotation takes place around the center P of the sheet. The sensors 4 to 8 installed in the table are preferably light barriers with respective light reflecting sensors. However, microswitches or similar sensors are also suitable for the present purposes.

Figure 3:
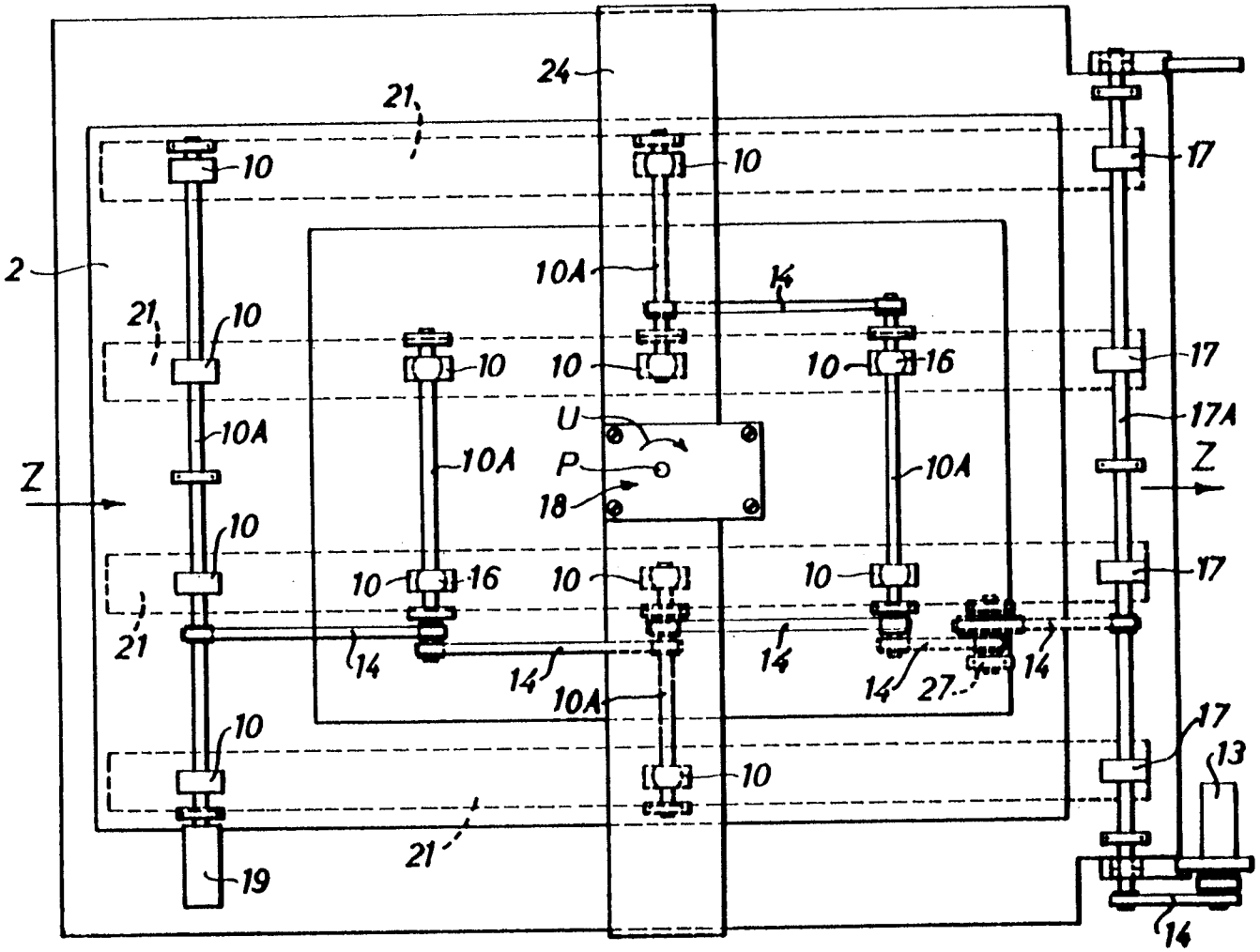
FIG. 3 illustrates a top plan view onto the supply table in the direction of arrow III in FIG. 2, also referred to as feed-in or sheet turntable, whereby longitudinal ball holders are permitted.

FIG. 3 illustrates the overall construction of the feed-in or supply and sheet turning table 2. FIG. 3 is a view in the direction of the arrow III in FIG. 2, however the ball holders 21 on top of the table 2 are indicated only by dashed lines. Further, certain elements are shown in full line under the assumption that the table plate itself has been removed. This assumption applies to the drive elements 10, 13, 14, 17, and 19. The cross-beam 24 is attached to the table 2 and will be described in more detail below. The drive rollers 10 and 17 extend through respective apertures in the table top from below the table top for driving the sheets. The infeed drive rollers 10 are interconnected by a drive shaft 10A, and are driven by a motor 19 or directly from drive means 37 of the printer. Further, drive rollers 10 are interconnected by drive shafts 10A also driven by the motor 19. The motor output from the motors 13 is connected to the drive shafts through gear pulleys and a plurality of gear belts 14. The control of the operation is accomplished by the electrical circuit shown in FIG. 5 to be described in more detail below. Normally, the infeed of sheets onto the table 2 will be driven by motor 19 or driving means 37 of the printer 1 at a lower speed than the speed of feeding the sheets away from the table 2, driven by motor 13. The drive rollers 17 function as feed-out rollers and are driven by a motor 13 or driving means 39 of the folding machine 9. Well known free-wheeling devices or over-running clutches may be used to permit the feed-in rollers 10 to run slower than the feed-out rollers 17, thereby avoiding that the feed-in rollers 10 apply a brake-action to the sheets.

As shown in FIG. 2, metal balls 16 are rotatably mounted in four longitudinal ball holders 21 on top of the table 2. These balls 16 press the paper sheets against the drive rollers 10 and 17 by their weight to assure a positive feed advance of all sheet sizes.

By driving the outgoing sheets faster than the incoming sheets, jamming is avoided. The infeed speed of the drive rollers 10 is determined by the feed-out speed of the printer 1. Thus, the rollers 17 are driven faster than the feed-out speed of the printer 1. As a result, the faster running rollers 17 with their balls 16 grip a sheet and move it out of the way without being hindered by the operation of the slower rotating transport rollers 10. Furthermore, the different speeds could be achieved by a single motor connected to the rollers 10 and 17 through gear belts and gear pulleys 27 and clutch providing different transmission rations. The feed-out speed is preferably three times the infeed speed.

FIG. 3 shows schematically the lifting and rotating mechanism 18 which will now be described in more detail with reference to FIG. 4. The mechanism 18 comprises a stationary mounting section 36. The stationary section 36 is rigidly connected to the table 2 by guide brackets 59 and by a guide bolt 60. The ball holders 21 are fixed to the crossbeam 24 which carries the above mentioned balls 16. A pressure plate 22 is mounted in a rotatable manner to the crossbeam 24. The pressure plate 22 holds a sheet against a turntable 20. The plate 22 is carried rotatably by a mounting flange and bearing 62 on a shaft 64 which in turn is mounted by a mounting flange 65 secured to the crossbeam 24.

Figure 4:
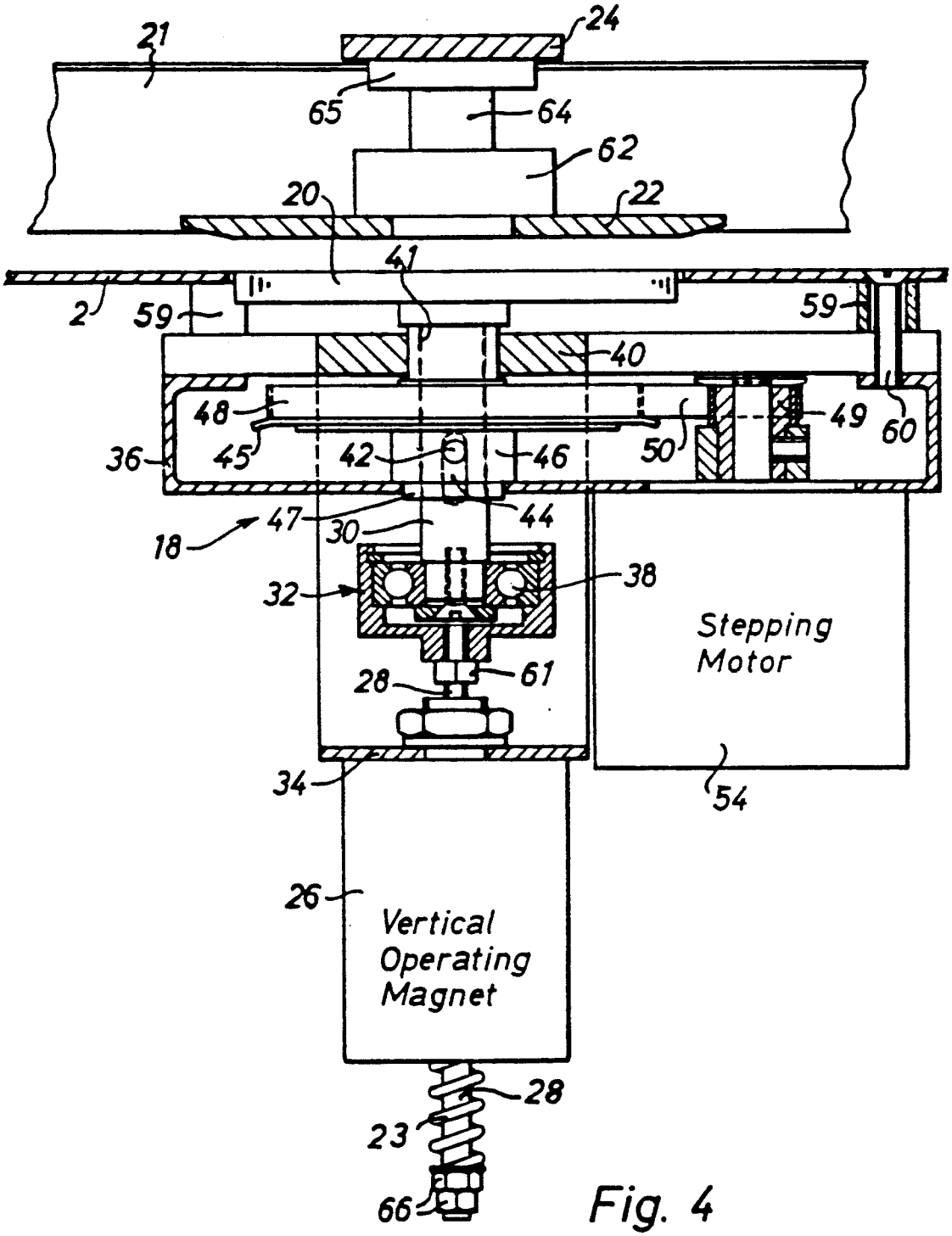
FIG. 4 shows a vertical section through a sheet lifting and rotating mechanism forming part of the sheet turntable.

The turntable 20 of FIG. 4 is rigidly secured to a shaft 30 for up and down movement with the aid of a vertical operating magnet 26 and a spring 23. The turntable 20 is also rotatable with the shaft 30 driven by a stepping motor 54. The components for the vertical movement of at least the middle part of a sheet will now be described in more detail. A plate 40 provides a mounting for a sleeve bearing 41 for the shaft 30 to rotatably hold the shaft 30. The magnet 26 is mounted to a bracket 34 which in turn is rigidly secured to the table housing. The magnet 26 comprises a solenoid coil shown schematically in FIG. 5 driven by a control amplifier 29. The solenoid coil of the magnet 26 operates an armature 28 in the form of a vertically movable lifting shaft 28 connected to the rotatable shaft 30 through a ball bearing 38 in a bearing housing 32. The bearing 38 in its housing 32 is thus movable vertically up and down. An axial adjustment of the bearing housing 32 and thus of the shaft 30 with the turntable 20 is possible by an adjustment nut 61 on the threaded end of the lifting shaft 28. As shown, the table 20 is in its lowermost position with the magnet 26 de-energized, whereby the top surface of the turntable 20 is flush with the top surface of the table 2.

A rotatable hub 46 is rotatably mounted in the bearing bracket 36, for example by a bearing shoulder 47 which may be a sleeve bearing or a ball bearing. Thus, the hub 46 is rotatable relative to the mounting bracket 36, but axially stationary with the mounting bracket 36. The shaft 30 has a longitudinal slot 44 which engages a cam pin 42 of the hub 46. Thus, the shaft 30 can move vertically up and down relative to the hub 46, but will rotate with the hub 46. In the position shown the cam pin 42 is in its uppermost position. The axial length of the slot 44 determines the upper and lower limits of the axial movement of the turntable 20. The lifting armature shaft 28 of the magnet 26 has a lower end carrying a compression spring 23 and adjustment nuts 66 on a threaded end of the armature shaft 28. Adjustment of the nuts 66 determines the biasing of the spring 23. When the armature shaft 28 moves upwardly to lift the turntable 20, the spring 23 is compressed, thereby providing a positive return force for all the components that are vertically movable, including the table 20. When the magnet 26 is not energized, the spring bias of the spring 23 is so adjusted that the turntable 20 takes up the above described position flush with the surface of the table 2.

The turntable 20 is rotatable by a drive mechanism including a stepping motor 54 mounted to the mounting bracket 36 and driving a gear pinion 49 which in turn drives a gear pulley 48 through a gear belt 50. The gear pulley 48 is rigidly secured to the hub 46 to rotate the latter and thus through the cam pin 42 the shaft 30 rotating the turntable 20. A guide plate 45 for the gear belt 50 is also mounted to the hub 46. The stepping motor 54 is controlled by a stepping motor control 25 shown in FIG. 5. Thus, the shaft 30 and with it the turntable 20 rigidly connected to the shaft 30 can move axially under the control of the magnet 26 and the spring 23 as well as rotationally under the control of the stepping motor 54.

Figure 5:
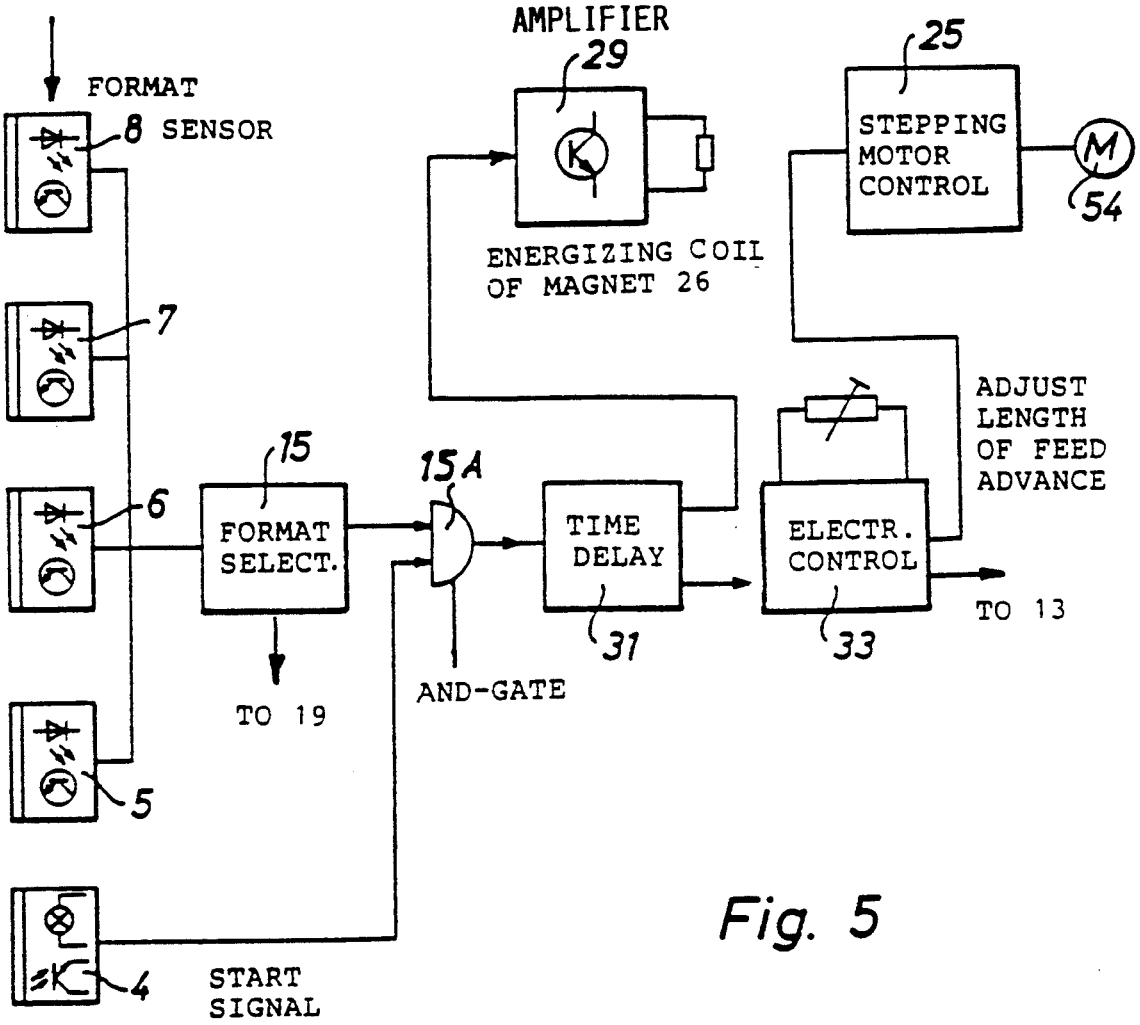
FIG. 5 illustrates a block circuit diagram of an electrical control circuit according to the invention for controlling the present apparatus.

Referring to FIG. 5, the present apparatus operates as follows. When a sheet 3 coming from the printer 1 with a first speed onto the supply and turntable 2, the sensors 5 to 8 will provide respective sheet information signals to the format selector 15 which has, as mentioned, comparators which compare the incoming signals with preset values in a memory to provide respective output signals to an AND-gate 15A which also receives a start signal from the sensor 4 which senses that a sheet has passed over the sensor 4 when the leading edge LE passes over the sensor 4. The sensors in combination determine the sheet format, that is, the sheet size, with sensor 8 laterally positioned.

Let it be assumed that a sheet 3A having a format A2 must be rotated by 90° around the point P in the clockwise direction as indicated by the arrow U in FIG. 1. The presence of a sheet of size A2 is recognized by the fact that the sheet does not cover the sensor 5. Once the sheet has been properly turned, a respective signal shows the fact that the sheet no longer covers the sensor 8, but now covers the sensors 5, 6, and 7.

As soon as the sensor, for example, a light barrier 7 is covered by the leading edge LE and simultaneously the sensor 5, such as a light barrier, is released, the format selector switch 15 will detect that this sheet has to be turned. The AND-gate 15A will provide a control signal to a timing circuit 31, the timing circuit 31 will first activate an amplifer circuit 29 for energizing the solenoid coil of the magnet 26 for lifting the turntable 20 as described above. When the lifting of the turntable 20 is completed, the sheet is positively held between the turntable 20 and the counterpressure plate 22 which is also rotatable as mentioned. The timing circuit 31 now provides a further output signal to the electrical control circuit 33 which in turn activates the stepping motor control 25 for the stepping motor 54 which now turns the turntable 20 and thus the sheet by 90°. Upon completion of the 90° turn, the amplifier 29 is switched off and the spring 23 lowers the table and with it the sheet. The turned sheet is driven by rollers 17 with a feed-out speed, for example three times higher than the infeed speed. The outfeed corresponds to the operational infeed speed of a folding machine 9 for example, of the type described above. This increased speed discharge of the sheets from the turntable 20 avoids interferences with further incoming sheets 3 or 3A. It is not necessary that the turntable 20 is turned back, since the stepping motor 54 following the next lifting motion will perform a predetermined 90° rotation.

For sheets which are extremely long, for example for drawings of electrical circuits, it is necessary to modify the speed of rollers 17. If the sheet is so long that it will be simultaneously in the printer 1 and in the folder 9, it will be necessary to reduce the speed of the driven rollers 17 and of the folder 9 to the speed of the printer 1. For adapting the speed of the driven rollers 17 and the folder 9 to the speed of the printer the electrical control circuit generates a signal for reduction of the speed of motor 13 and preferably of the motor of the folder. Such a signal is generated by the format selector 15 if all sensors 4, 5, 6 and 7 are covered by a long sheet.

Referring again to FIG. 4, the operation of the lifting and lowering of the turntable 20 is also possible without difficulties if the cam pin 42 is provided on the shaft 30 instead of on the hub 46 and if the slot 44 is provided in the hub 46 instead of in the shaft 30 as described above.

In this modification with camp pin 42 on the shaft 30, the cam pin 42 would be shown at the lower end of the slot 44 instead of at the upper end thereof as is illustrated in FIG. 4.

Although the invention has been described with reference to specific example embodiments, it will be appreciated that it is intended to cover all modifications and equivalents within the scope of the appended claims.

What I claim is:

1. A method for feeding sheets having differing formats arriving with a first speed and with a random positional orientation to a further sheet processing operation, comprising the following steps:

(a) generating sheet format recognition signals for distinguishing at least properly oriented sheets from improperly oriented sheets to provide respective control signals which take a sheet length into account, (b) lifting of at least the middle part of an improperly oriented sheet out of a sheet travel plane in response to at least one of said control signals, (c) rotating a lifted sheet into a proper orientation in response to another control signal;

(d) lowering a rotated sheet back into said sheet travel plane, and wherein (e) feed advancing said lowered and rotated sheet toward said further sheet processing operation, with a second speed in accordance with said control signals that take said sheet length into account for avoiding an interference between sheets.

2. The method of claim 1, wherein said rotating step is performed to rotate said improperly oriented sheet by 90° to bring a rotated sheet into proper orientation for a further sheet handling operation.

3. The method of claim 2, comprising lifting a turntable with said sheet on said turntable, holding said sheet to said turntable, stepping said turntable through said 90°, lowering said turntable thereby releasing said sheet from said turntable, and feeding said sheet with said second higher speed away from said turntable.

4. The method of claim 1, wherein said arriving sheets all move in the same direction, and wherein all departing sheets moving with said second speed still move in the same direction.

5. The method of claim 1, further comprising stopping said improperly oriented sheet prior to said lifting step.

6. The method of claim 1, further comprising advancing said sheets with said random positional orientation from a printer output onto a turntable with said first speed, reorienting said sheet with the aid of said turntable, and then feeding the reoriented sheet with said second higher speed to a sheet folding apparatus.

7. The method of claim 1, comprising controlling said feed advancing in accordance with said control signals so that said second speed is higher than said first speed for relatively short sheets.

8. The method of claim 1, comprising controlling said feed advancing in accordance with said control signals so that said second speed is substantially equal to said first speed for relatively long sheets.

9. An apparatus for feeding sheets having differing formats arriving with a first sheet advance speed from a first sheet processing station and with a random positional orientation, to a second sheet processing station, comprising:

(a) a sheet feeding table including control means with sensors for sensing incoming sheets to generate sheet format recognition signals for distinguishing properly oriented sheets from improperly oriented sheets to provide respective control signals which take a sheet length into account, (b) means for lifting at least the middle part of an improperly oriented sheet out of a sheet travel plane in response to a first control signal, (c) means for rotating a lifted sheet into a proper orientation in response to a second control signal, (d) means for lowering a rotated sheet back into said sheet travel plane, and (e) sheet feeding elements in said sheet feeding table for advancing a lowered and rotated sheet toward said second sheet processing station with a second sheet advance speed in response to said control signals which take said sheet length into account for avoiding an interference between sheets.

10. The apparatus of claim 9, wherein said means for rotating comprise a turntable with a stepping motor for rotating said turntable, said means for lifting comprising an electromagnet for lifting said turntable, and wherein said means for lowering comprise a spring for lowering said turntable.

11. The apparatus of claim 10, further comprising a rotatably mounted counter holder plate, and means for rotatably mounting said counter holder plate vertically above said turntable for holding a sheet between said turntable and said counter holder plate when said turntable is lifted and rotating, for holding a sheet in a fixed position relative to said turntable while said turntable is rotating with said sheet.

12. The apparatus of claim 10, wherein said turntable comprises a central rotatable shaft (30), means for rotatably mounting said shaft, said electromagnet comprising a lifting armature rotatably secured to said turntable shaft, said means for rotating further comprising a drive wheel and means connecting said drive wheel to said stepping motor, said drive wheel (48) comprising a rotatably mounted hub (46) through which said turntable shaft (30) extends in an axially slidable manner, and means for transmitting a rotation of said drive wheel (48) with its hub (46) to said turntable shaft (30).

13. The apparatus of claim 12, wherein said means for transmitting a rotation comprise a pin and groove engaged by said pin.

14. The apparatus of claim 13, wherein said pin is rigidly secured to said hub (46) and rides up and down in said longitudinal groove (44) formed in said turntable shaft (30).

15. The apparatus of claim 9, further comprising hinge means (56) for mounting said sheet feeding table so that said sheet feeding table can be tilted between an operative and an inoperative position.

16. The apparatus of claim 9, wherein said sensors (4 to 8) of said control means comprise light sensors, and wherein said control means further comprise signal processing circuit means connected to said light sensors for producing said control signals for selecting said improperly oriented sheets that require reorientation.

17. The apparatus of claim 9, wherein said first sheet processing station is a printer or copier, and wherein said second sheet processing station is a sheet folding apparatus, said apparatus for feeding sheets being positioned between said printer and said sheet folding apparatus.

18. The apparatus of claim 9, wherein said sheet feeding elements comprise sheet infeeding rollers (10) and sheet outfeeding rollers (17) and means for driving said infeeding rollers with said first sheet advance speed and said outfeeding rollers with said second higher feed advance speed.

19. The apparatus of claim 9, comprising at least four sensors, three of said four sensors being arranged along a central part of said sheet feeding table and one sensor of said four sensors being arranged outside said central part of said sheet feeding table.

20. The apparatus of claim 9, wherein said sheet feeding elements comprise rollers and drive motors (13, 19) for said rollers, and a control circuit for controlling said motors, so that said second speed is higher than said first speed for relatively short sheets.

21. The apparatus of claim 9, wherein said sheet feeding elements comprise rollers and drive motors (13, 19) for said rollers, and a control cirucit for controlling said motors, so that said second speed is substantially equal to said first speed for relatively long sheets.

* * * * *